United States Patent [19]

Santo

[11] Patent Number: 4,651,368

[45] Date of Patent: Mar. 24, 1987

[54] MARGINAL PERIMETER SUPPORT CONTAINMENT CHAMBER FOR A FLOATATION SLEEP SYSTEM

[76] Inventor: Philip J. Santo, 3750 Monroe Ave., Pittsford, N.Y. 14534

[21] Appl. No.: 773,443

[22] Filed: Sep. 6, 1985

[51] Int. Cl.[4] ..... A47C 27/10

[52] U.S. Cl. ..... 5/452; 5/451

[58] Field of Search ..... 5/452, 451, 450, 449, 5/441, 422, 455

[56] References Cited

U.S. PATENT DOCUMENTS

| | | | |
|---|---|---|---|
| 3,735,432 | 5/1973 | Kreten et al. | 5/451 |
| 4,491,993 | 1/1985 | Santo | 5/451 |
| 4,501,036 | 2/1985 | Santo | 5/451 |
| 4,513,463 | 4/1985 | Santo | 5/451 |

*Primary Examiner*—Alexander Grosz
*Attorney, Agent, or Firm*—Lawrence P. Kessler

[57] ABSTRACT

An improved marginal perimeter support containment chamber of simplified construction, for use with a floatation sleep system including a liquid-containing bladder, wherein all areas of such chamber are accessible for repair. The improved chamber includes an elongated chamber adapted to contain a mechanism for supporting the marginal perimeter of a bladder. A flexible, dimensionally stable sheet is connected to the bottom surface of the elongated chamber. A plurality of strips of flexible, dimensionally stable material are provided, with the dimension of respective material strips between opposed longitudinal edges being substantially equal to one half the cross-sectional circumference of the elongated chamber. One longitudinal edge of the respective material strips is coupled to the sheet interiorly of the projection of the elongated chamber on such sheet. The opposite longitudinal edge of the respective material strips is releasably connected to the upper surface of the elongated chamber such that the material strips and the sheet form a cavity for a bladder. The material strips are releasable from the elongated chamber to provide access to that portion of the chamber located between the strips and the sheet. Moreover, the upper surface of a bladder may be releasably connected to the elongated chamber to prevent separation of the bladder from the chamber.

9 Claims, 3 Drawing Figures

MARGINAL PERIMETER SUPPORT CONTAINMENT CHAMBER FOR A FLOATATION SLEEP SYSTEM

BACKGROUND OF THE INVENTION

This invention relates generally to floatation sleep systems, and more particularly to an improved marginal perimeter support containment chamber for a floatation sleep system.

In my U.S. Pat. No 4,513,463, issued Apr. 30, 1985, I have disclosed an advancement in floatation sleep systems of the universal type where the bladder and the perimeter support are seperable, and wherein the bladder may be readily replaced without having to replace the entire sleep system. Such advanced floatation sleep system includes an accessible perimeter containment chamber containing a marginal perimeter support. A flexible, dimensionally stable sheet is connected to the upper portion of the perimeter chamber. The sheet forms a support chamber for a water-containing bladder.

Such support chamber is suspended from the perimeter containment chamber, whereby when a bladder is inserted in the support chamber, the weight of the bladder exerts a force through such chamber on the perimeter containment chamber to hold the marginal perimeter support in effective support relation to such bladder. Specifically, the sheet forming the support chamber is of an overall dimension greater than the distance between opposed portions of the perimeter containment chamber and less than the distance between such opposed portions plus twice the vertical height of such perimeter containment chamber.

While this patented advanced floatation sleep system provides the intended universality and adequately functions to retain the perimeter support in effective support relation with its contained bladder, it is of a relatively complicated construction. Further, if there is a breach in the perimeter containment chamber between such chamber and the sheet forming the bladder support chamber, such breach is not accessible for repair. Therefore, the entire marginal perimeter support containment chamber must be replaced.

SUMMARY OF THE INVENTION

This invention is directed to an improved marginal perimeter support containment chamber of simplified construction, for use with a floatation sleep system including a liquid-containing bladder, wherein all areas of such chamber are accessible for repair. The improved chamber includes an elongated chamber adapted to contain a mechanism for supporting the marginal perimeter of a bladder. A flexible, dimensionally stable sheet is connected to the bottom surface of the elongated chamber. A plurality of strips of flexible, dimensionally stable material are provided, with the dimension of respective material strips between opposed longitudinal edges being substantially equal to one half the cross-sectional circumference of the elongated chamber. One longitudinal edge of the respective material strips is coupled to the sheet interiorly of the projection of the elongated chamber on such sheet. The opposite longitudinal edge of the respective material strips is releasably connected to the upper surface of the elongated chamber such that the material strips and the sheet form a cavity for a bladder. Accordingly, a portion of a bladder received within such cavity overlies the material strips, with the weight of the bladder acting on such strips to hold the elongated chamber in effective marginal perimeter support relation with the bladder. The material strips are releasable from the elongated chamber to provide access to that portion of the chamber located between the strips and the sheet. Moreover, the upper surface of a bladder may be releasably connected to the elongated chamber to prevent separation of the bladder from the chamber.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
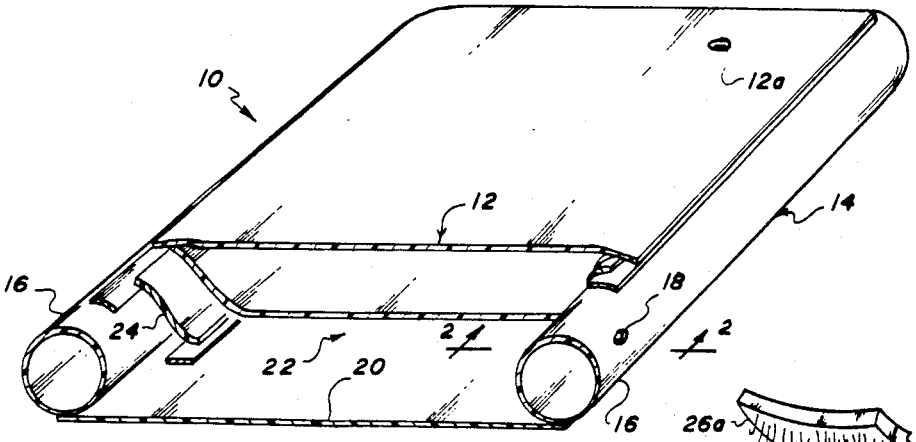
FIG. 1 is a view, in perspective, of an improved marginal perimeter support containment chamber for a floatation sleep system according to this invention, with portions broken away or removed to facilitate viewing.
Figure 3:
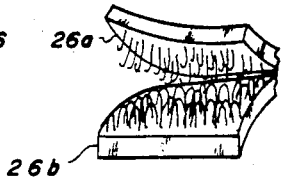
FIG. 3 is an end elevational view, on an enlarged scale, of an exemplary hook and loop type fastener.
Figure 2:
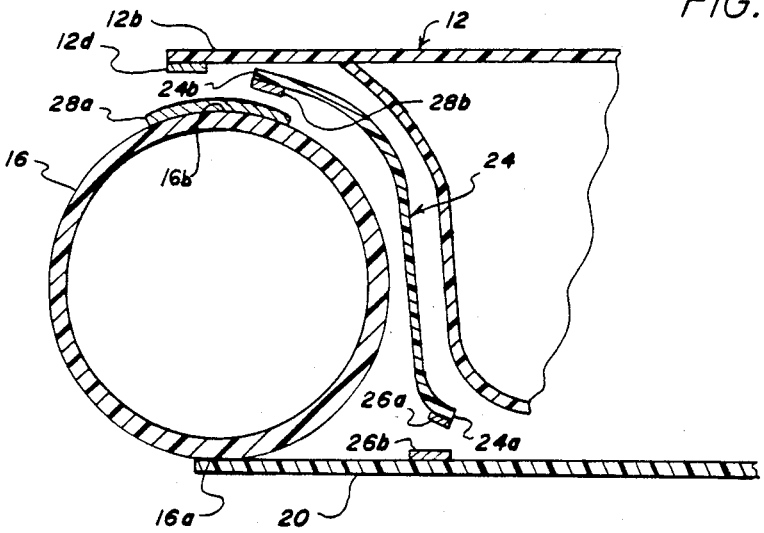
FIG. 2 is an exploded end elevational view in cross-section, on an enlarged scale, of a portion of the structure of FIG. 1 taken along lines 2—2.

Referring now to the accompanying drawings, the floatation sleep system according to this invention is designated generally by the numeral 10. The floatation sleep system 10 includes a bladder 12 and a marginal perimeter support containment chamber 14 for such bladder. The bladder 12 is formed of a flexible, dimensionally stable, liquid impervious material, such as polyethylene or polypropylene for example. Such material is configured as a chamber with substantially rectangular cross-sectional dimensions. The bladder 12 includes a valve **12*a*** communicating with the interior of the chamber to enable the bladder to be filled with a body-supporting liquid such as water. Of course, other chamber configurations are suitable for use with this invention and, other body-supporting liquids may be employed in the bladder. Moreover, the bladder chamber may utilize any of the various known wave-reducing mechanisms such as fiber fill or hydraulic baffles.

The chamber 16 if formed of flexible, dimensionally stable, liquid impervious material (such as used to form the bladder), and may be continuous or divided into independent chambers such as shown in my U.S. Pat. No. 4,501,036 issued Feb. 26, 1985. The interior of the chamber 16 is adapted to be filled with a perimeter support mechanism, such as pressurized air admitted through valve 18 for example. Of course, other perimeter support mechanisms such as foam are suitable for use in this invention. When viewed in plan, the chamber 16 is configured to surround the marginal perimeter of a bladder (e.g. for a rectangular bladder, the chamber 16 is substantially rectangular). A sheet 20 of material, similar to the material forming the chamber 16 for example, is attached to the bottom surface **16*a*** of the chamber, such as by heat sealing for example.

A cavity 22, adapted to receive the bladder 12, is formed by the sheet 20 and a plurality of elongated strips 24 respectively connected between the sheet and the elongated chamber 16. The strips 24 are formed of a material similar to the material forming the elongated chamber 16 for example. The strips 24 have opposed longitudinal marginal edges 24*a* and 24*b*, with the dimension between such edges being substantially equal to one-half the cross-sectional circumference of the elongated chamber 16. Respective edges 24*a* are connected to the sheet 20 at a location interiorly of the projection of the elongated chamber 16 on the sheet 20. While such connection may be effected by heat sealing, for example, it has been determined that an effective connection is provided by matable members 26*a*, 26*b* of a fastener, referred to as hook and loop fasteners. The member 26*a* and 26*b* are fixed respectively to the edges 24*a* and the sheet 20 at the location where connection is desired. Pressing the members 26*a*, 26*b* together then connects the strips 24 to the sheet 20. Similarly, the respective opposing edges 24*b* of the strips 24 are readily releasably connected to the upper surface 16*b* of the elongated chamber 16. That is, matable members 28*a*, 28*b* (of hook and loop fasteners) are respectively fixed to the upper surface 16*b* of the elongated chamber 16 and edges 24*b* of the strips 24. Pressing the members 28*a*, 28*b* together connects the strips 24 to the upper surface 16*b* of chamber 16. Release of the members 26*a*, 26*b* or members 28*a*, 28*b* is effected by merely pulling such members apart.

The particularly described dimension of the strips 24 and their points of connection to the elongated chamber 16 and sheet 20 is important in configuring the cavity 22 such that when a bladder is received in the cavity, a portion thereof overlies the strips 24. The weight of the bladder on the strips acts on the strips to hold the elongated chamber 16 in effective marginal perimeter support with the bladder in the manner shown in my aforementioned U.S. Pat. No. 4,513,463. Moreover, the releasable connection of the strips 24 to the elongated chamber 16, enables the portion of the elongated chamber between the strips and the sheet 20 to be readily accessible. That is, if for example a breach in the chamber 16 occurs between the strips 24 and the sheet 20, the strip adjacent to such breach is readily detached from the elongated chamber. The breach is then accessible for repair. This enables the elongated chamber 16 to be readily repaired without having to replace the entire marginal perimeter support containment chamber 14.

The above-described construction for enabling access to the elongated chamber 16 of the marginal perimeter support containment chamber 14 also provides a simplified mechanism for solving another problem peculiar to floatation sleep systems employing a bladder within such containment chamber; i.e., the propensity of the bladder to move away from the elongated chamber when sitting on the edge of such sleep system. Such problem is solved by making the fastener member 28*a* of a dimension whereby the connection of matable member 28*b* (fixed to the edges 24*b* of strip 24) is along an interior marginal edge thereof. The bladder 12 is provided with a member 12*b* extending outwardly from the upper surface 12*c* of the bladder. The member 12*b* has a matable fastener member 12*d*, connectable to the exterior marginal edge of the member 28*a* fixed thereto. In this manner, when the bladder 12 is in the chamber 14, the member 12*d* is pressed together with member 28*a* so that the upper surface of the bladder is secured to the elongated chamber 16 and cannot be forced away from such chamber when one sits on the edge of the sleep system. Of course the same effect is achieved with member 12*b* extending around the elongated chamber 16 and connected thereto at the bottom surface or to the bottom surface of sheet 20.

The invention has been described in detail with particular reference to a preferred embodiment thereof, but it will be understood that variations and modifications can be effected within the spirit and scope of the invention.

I claim:

1. For use in a floatation sleep system including a bladder adapted to contain a body-supporting liquid, an improved marginal perimeter support containment chamber, said improved chamber comprising:

an elongated chamber adapted to contain a mechanism for supporting the marginal perimeter of a bladder;

a flexible, dimensionally stable, sheet connected to the bottom surface of said elongated chamber;

a plurality of strips of flexible, dimensionally stable material, the dimension of said respective material strips between opposed longitudinal edges being substantially equal to one half the cross-sectional circumference of said elongated chamber;

means for coupling respective one longitudinal edges of said material strips to said sheet interiorly of the projection of said elongated chamber on said sheet; and means for releasably connecting the respective opposite longitudinal edges of said material strips to the upper surface of said elongated chamber such that said material strips and said sheet form a cavity for a bladder, whereby a portion of a bladder received within such cavity overlies said material strips with the weight of such bladder acting on said strips to hold the elongated chamber in effective marginal perimeter support relation with such bladder, and wherein said strips are releasable from said elongated chamber to provide access to that portion of said chamber located between said strips and said sheet.

2. The invention of claim 1 wherein said coupling means includes means for releasably connecting said one longitudinal edge of said material strips to said sheet.

3. The invention of claim 3 wherein said releasable connecting means is a hook and loop type fastener.

4. The invention of claim 1 further including means for releasably connecting the upper surface of a bladder received in such cavity to prevent such bladder from moving away from said elongated chamber.

5. The invention of claim 4 wherein said releasable connecting means includes a first member attached to the upper surface of said elongated chamber, a second member attached to said opposite longitudinal edge of said material strip and matable with said first member adjacent to an interior marginal edge thereof, and a third member attached to the upper surface of a bladder and matable with said first member adjacent to an exterior marginal edge thereof.

6. The invention of claim 5 wherein said first member is an elongated strip of the male portion of a hook and loop type fastener, and said second and third members are elongated strips of the female portion of a hook and loop type fastener.

7. A floatation sleep system comprising:

a bladder adapted to contain a body-supporting liquid, said bladder including a member extending outwardly from the upper surface of said bladder;

an elongated chamber adapted to contain a mechanism for supporting the marginal perimeter of a bladder;

a flexible, dimensionally stable, sheet connected to the bottom surface of said elongated chamber;

a plurality of strips of flexible, dimensionally stable material, the dimension of said respective material strips between opposed longitudinal edges being substantially equal to one half the cross-sectional circumference of said elongated chamber;

means for coupling respective one longitudinal edges of said material strips to said sheet interiorly of the projection of said elongated chamber on said sheet; and means for releasably connecting the respective opposite longitudinal edges of said material strips and said member extending from said bladder to said elongated chamber such that (1) said material strips and said sheet from a cavity for a bladder, whereby a portion of a bladder received within such cavity overlies said material strips with the weight of such bladder acting on said strips to hold the elongated chamber in effective marginal perimeter support relation with such bladder, and wherein said strips are releasable from said elongated chamber to provide access to that portion of said chamber located between said strips and said sheet, and (2) the upper surface of said bladder is prevented from moving away from said elongated chamber.

8. The invention of claim 7 wherein said releasable connecting means includes a first member attached to the upper surface of said elongated chamber, a second member attached to said opposite longitudinal edge of said material strip and matable with said first member adjacent to an interior marginal edge thereof, and a third member attached to said member extending from the upper surface of a bladder and matable with said first member adjacent to an exterior marginal edge thereof.

9. The invention of claim 8 wherein said first member is an elongated strip of the male portion of a hook and loop type fastener, and said second and third members are elongated strips of the female portion of a hook and loop type fastener.

* * * * *